US006671156B2

(12) United States Patent
Di Lieto et al.

(10) Patent No.: US 6,671,156 B2
(45) **Date of Patent: *Dec. 30, 2003**

(54) METHOD FOR CONTROLLING ELECTROMAGNETIC ACTUATORS FOR OPERATING INDUCTION AND EXHAUST VALVES OF INTERNAL COMBUSTION ENGINES

(75) Inventors: Nicola Di Lieto, Salerno (IT); Gilberto Burgio, Ferrara (IT); Roberto Flora, Forli' (IT)

(73) Assignee: Magneti Marelli S.p.A., Milan (IT)

( * ) Notice: Subject to any disclaimer, the term of this patent is extended or adjusted under 35 U.S.C. 154(b) by 335 days.

This patent is subject to a terminal disclaimer.

(21) Appl. No.: 09/736,125

(22) Filed: Dec. 15, 2000

(65) Prior Publication Data

US 2001/0004309 A1 Jun. 21, 2001

(30) Foreign Application Priority Data

Dec. 17, 1999 (IT) ..... BO99A0689

(51) Int. Cl.[7] ..... H01H 47/00
(52) U.S. Cl. ..... 361/139; 361/152; 361/160
(58) Field of Search ..... 361/139, 152, 361/160

(56) References Cited

U.S. PATENT DOCUMENTS 3,736,488 A 5/1973 Abraham et al. ..... 318/696
4,724,865 A 2/1988 Hirano et al. ..... 137/186
6,332,436 B1 * 12/2001 Di Lieto et al. ..... 123/90.11

FOREIGN PATENT DOCUMENTS

EP 0 959 479 A2 11/1999 ..... H01F/7/18

* cited by examiner

*Primary Examiner*—Stephen W. Jackson
(74) *Attorney, Agent, or Firm*—Arent Fox Kintner Plotkin & Kahn, PLLC

(57) ABSTRACT

A method for controlling electromagnetic actuators for operating induction and exhaust valves in internal combustion engines where one actuator, connected to a control unit, is coupled to a respective valve having a real position and includes a movable element magnetically driven by means of a resultant force to control the movement of the said valve between a closure position and a fully open position; the control unit is further connected to a piloting unit and includes a supervision block, an open loop control block, a closed loop control block and a selector block commanded by a switching signal generated by the supervision block. The method includes the steps of: operating in an open loop control mode of the real position; operating in a closed loop control mode of the real position; and alternatively selecting the open loop control mode and the closed loop control mode.

19 Claims, 6 Drawing Sheets

| ST | S1 | S2 | S3 | S4 |
|---|---|---|---|---|
| COM | UP | UP | DOWN | DOWN |
| SW1 | OPEN | CLOSED | CLOSED | OPEN |
| $FD_{SUP}$ | SLOW | FAST | FAST | SLOW |
| $FD_{INF}$ | SLOW | FAST | FAST | SLOW |
| $I_{OLSUP}$ | $I_{HUP}$ | --- | --- | 0 |
| $I_{OLINF}$ | 0 | --- | --- | $I_{HDOWN}$ |

Fig.4

| ST | S1 | S2 | S3 | S4 | S5 | S6 |
|---|---|---|---|---|---|---|
| COM | UP | UP | DOWN | DOWN | UP | DOWN |
| SW1 | OPEN | CLOSED | CLOSED | OPEN | CLOSED | CLOSED |
| SW2 | --- | CL1 | CL1 | --- | CL2 | CL2 |
| $FD_{SUP}$ | SLOW | FAST | FAST | SLOW | FAST | SLOW |
| $FD_{INF}$ | SLOW | FAST | FAST | SLOW | SLOW | FAST |
| $I_{DSUP}$ | --- | $I_{NOM} + I_G \lvert Z_{SUP} - Z \rvert$ | 0 | --- | --- | --- |
| $I_{DINF}$ | --- | 0 | $I_{NOM} + I_G \lvert Z_{INF} - Z \rvert$ | --- | --- | --- |

Fig.10

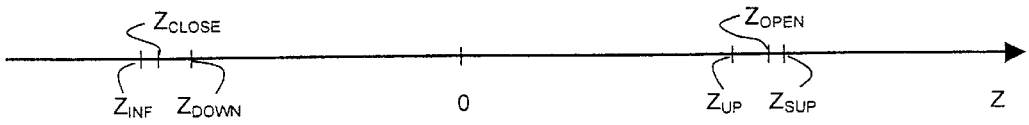

Fig.5

METHOD FOR CONTROLLING ELECTROMAGNETIC ACTUATORS FOR OPERATING INDUCTION AND EXHAUST VALVES OF INTERNAL COMBUSTION ENGINES

The present invention relates to a method for controlling electromagnetic actuators for operating induction and exhaust valves of internal combustion engines.

BACKGROUND OF THE INVENTION

As is known, there are currently under development propulsion units in which the operation of the induction and exhaust valves is managed by means of the use of electromagnetic actuators which replace the purely mechanical distribution systems (camshafts). Whilst, in fact, conventional distribution systems require the definition of a valve lifting profile which represents an acceptable compromise for all the possible operating conditions of the engine, the use of an electromagneticaly controlled distribution system makes it possible to vary the phase as a function of the operating point of the engine in such a way as to obtain an optimal efficiency in all operating conditions.

Therefore various control methods have been developed which allow the valves to be operated by means of the electromagnetic actuators in dependence on the desired timing and position and velocity profiles. Moreover they must avoid the possibility that, during time intervals when the valve is stationary, in which the valves are maintained shut in the closure position or in the fully open position, possible disturbing forces may cause unwanted displacements of the valves themselves. In fact, even partial unwanted opening or closing, if not rapidly opposed, can significantly alter the design flow of air from the induction manifold towards the cylinders, thereby degrading the performance and efficiency of the engine.

The known methods, moreover, have several disadvantages. According to these methods, in fact, for the purpose of opposing the disturbing forces which act on the valves and retaining or rapidly returning the valves themselves into the respective desired positions, during the time periods when the valves are stationary the electromagnets must be supplied with electrical currents which are significantly greater than the minimum currents required in nominal conditions. Moreover, the overall duration of the time period for which each valve is stationary is in one engine cycle, significantly greater than the time period for which it is in motion. There is, therefore, a high consumption of electrical energy caused by the fact that, for almost the entire duration of each engine cycle the current consumed by the electromagnets must be sufficient not only to maintain the valves in the desired nominal conditions, but also to guarantee a margin of safety with respect to possible unwanted displacements. This high consumption detrimentally affects the overall efficiency of the engine, reducing it disadvantageously.

SUMMARY OF THE INVENTION

The object of the present invention is to provide a method for the control of electromagnetic actuators which will be free from the described disadvantages and, in particular, which will allow the overall consumption of electrical energy to be reduced.

According to the present invention there is provided a method for controlling electromagnetic actuators for operating induction and exhaust valves in internal combustion engines, where an actuator connected to a control unit is coupled to a respective valve having a real position and comprising a magnetically actuated element, moveable by means of a resultant force to control the movement of the said valve between a closure position and a fully open position; the said control unit being connected to piloting means and comprising supervision means, open loop control means, closed loop control means and selector means controlled by a switching signal generated by the said supervision means; the said first selector means being operable to connect the said piloting means selectively to the said open loop control means and the said closed loop control means; the method being characterised by the fact that it comprises the steps of:

a) operating in an open loop real position control mode;

b) operating in a closed loop real position control mode; and c) alternatively selecting the said open loop control mode and the said closed loop control mode.

BRIEF DESCRIPTION OF THE DRAWINGS

For a better understanding of the invention a preferred embodiment will now be described purely by way of non-limitative example with reference to the attached drawings, in which:

FIG. 4 is a table relating to the first embodiment of the present method;

FIG. 5 is a graph showing quantities utilised in the present method;

FIG. 10 is a table relating to the second embodiment of the present invention;

DETAILED DESCRIPTION OF THE INVENTION

Figure 1:
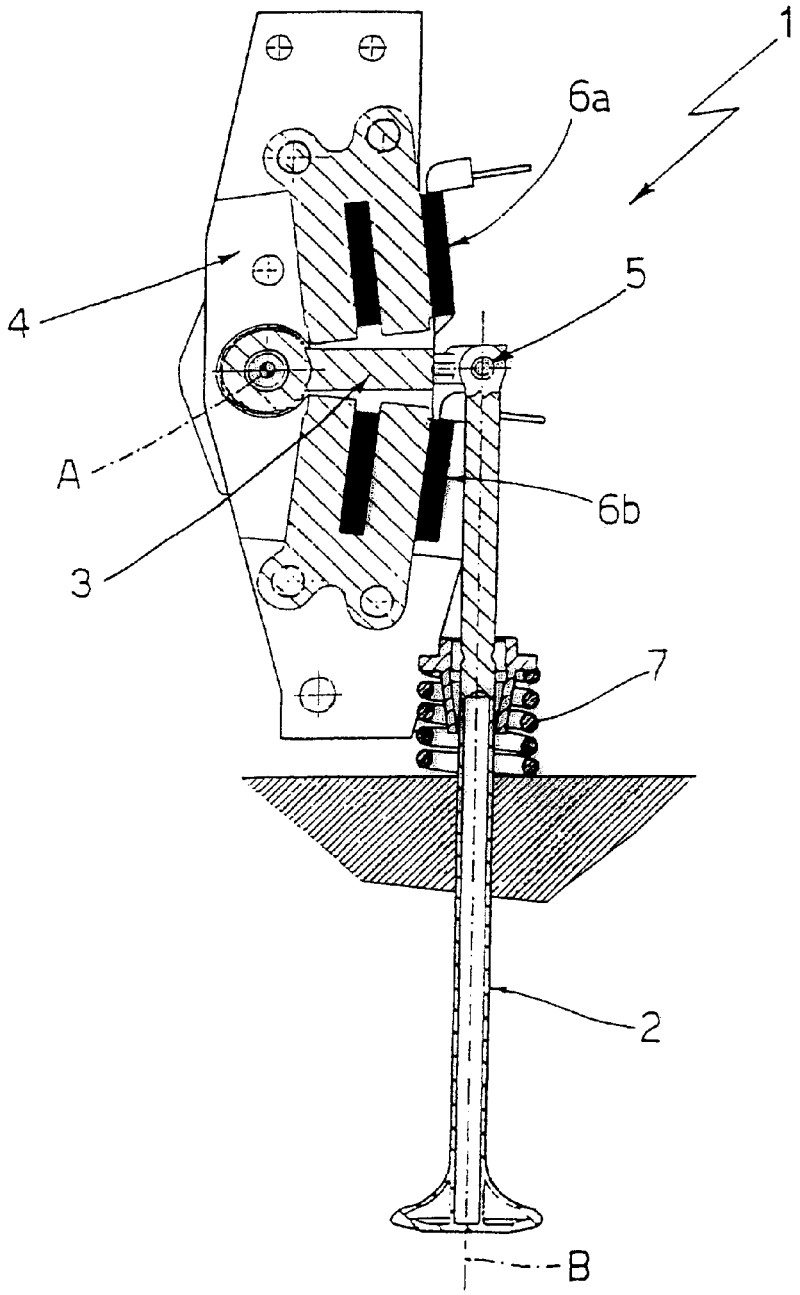
FIG. 1 is a partially sectioned side view of an induction or exhaust valve and the corresponding electromagnetic actuator.

With reference to FIG. 1, an electromagnetic actuator 1, controlled by the control system according to the present invention, is coupled to an induction or exhaust valve 2 of an internal combustion engine and comprises: a rocker arm 3 of ferromagnetic material having a first end pivoted to a fixed support 4 in such a way as to be able to reciprocate about a horizontal axis A of rotation perpendicular to a longitudinal axis B of the valve 2, and a second end connected by means of a pivot 5 to an upper end of the valve 2; a valve-opening electromagnet 6*a* and a valve-closing electromagnet 6*b* disposed on opposite sides of the body of the rocker arm 3 in such a way as to be able to act when controlled alternatively or simultaneously, exercising a net force F on the rocker arm 3 to make it turn about the axis of rotation; and finally a resilient element 7 operable to maintain the rocker arm 3 in a rest position in which it is equidistant between the pole pieces of the two electromagnets 6 in such a way as to maintain the valve 2 in an intermediate position between a closure position $Z_{SUP}$ (upper contact) and a fully open position $Z_{INF}$ (lower contact) which positions the valve 23 assumes when the rocker arm 3 is disposed in contact with the upper pole of the electromagnet 6 and the lower pole of the electromagnetic 6 respectively.

For simplicity, hereinafter in this discussion reference will be made to a single valve-actuator unit and, furthermore, the valve-opening electromagnet 6*a* and valve-closure electromagnets 6*b* will be indicated as the upper electromagnet and the lower electromagnet respectively. It is, naturally, intended that the method explained is utilised for simultaneous control of the movement of all the induction and exhaust valves present in an engine.

Reference will now be made to the position of the valve 2 in a direction parallel to the longitudinal axis B with respect to the rest position originally assumed; moreover, by "motion phase" it will be intended to identify the time intervals in which the valve 2 is moving between the closure position and the fully open position, whilst the term "stationary phase" will indicate the time intervals during which the valve 2 must be held stationary in either the closure position or the fully open position.

Figure 2:
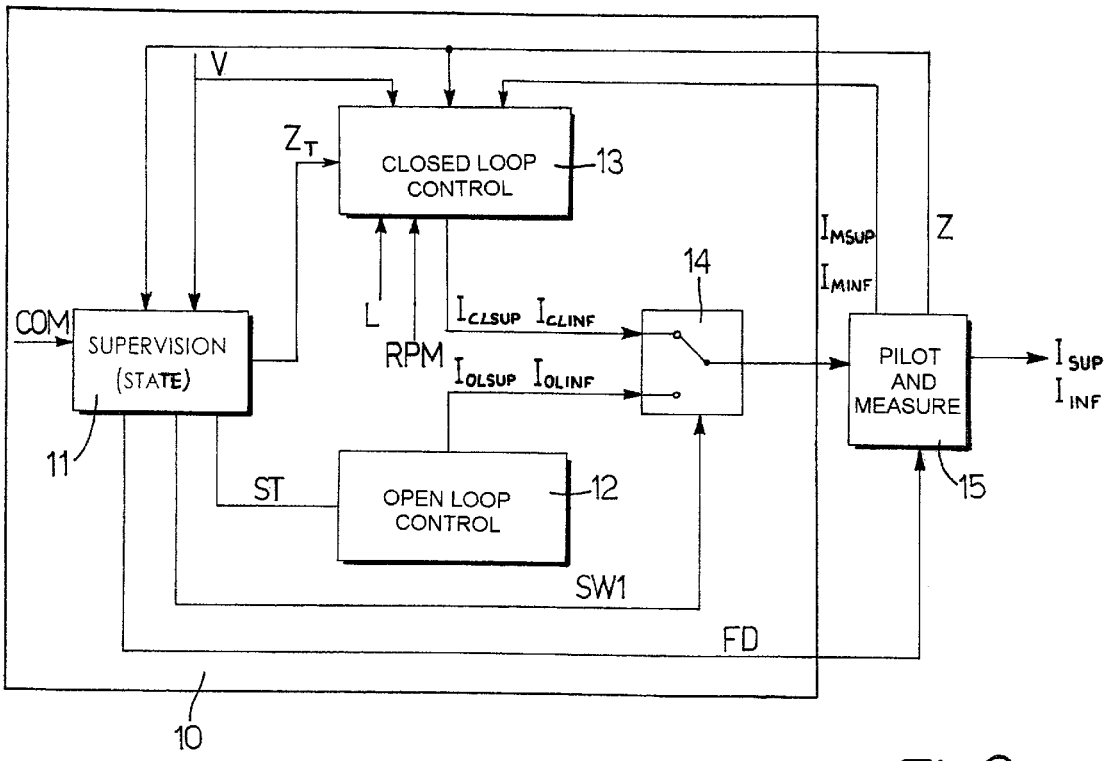
FIG. 2 is a simplified block diagram relating to the method of control according to the present invention in a first embodiment.

In FIG. 2 there is shown a control unit 10 comprising a supervision block 11, an open loop control block 12, a closed loop control block 13 and a first selector 14. The control unit 10 is interfaced with a measurement and piloting device 15 which delivers an upper current $I_{SUP}$ and a lower current $I_{INF}$ to the upper electromagnets 6*a* and, respectively, to the lower electromagnets 6*b* to exert on the rocker arm 3 a resultant force F of predetermined value. Moreover the measurement and piloting device 15 provides at its output, in a known manner, a measurement of the real position Z of the valve 2 and a measurement $I_{MSUP}$ and $I_{MINF}$ of the upper current $I_{SUP}$ and lower currents $I_{INF}$.

The supervision block 11 receives at its input, from the control unit 10, a control signal COM generated according to a known strategy, an estimate or equivalently a measurement, of the real velocity V and, moreover, the measurement of the real position Z provided by the measurement and piloting unit 15. In particular, the control signal COM can assume alternatively a first control value ("UP") and a second control value ("DOWN") to determine the closure and, respectively, the opening of the valve 2.

As will be explained hereinafter, the supervision block 11 updates a control state ("STATE") of the actuator 1 and provides at least five signals at its output, among which are: a first switching signal SW1 having a first switching value ("OPEN") and a second switching value ("CLOSED"); a state signal ST, representative of the control state ("STATE"); an objective position signal $Z_T$ indicative of the position which the valve T must assume and corresponding alternatively to the closure position $Z_{SUP}$ and fully open position $Z_{INF}$; an upper exhaust signal $F_{DSUP}$ and a lower exhaust signal $F_{DINF}$, having a first exhaust value ("SLOW") and a second exhaust value ("FAST") for selection between two different modes of operation of the upper electromagnets 6*a* and lower electromagnets 6*b* respectively.

The open loop control block 12 receives at it input the first state signal ST1 from the supervision block 11 and provides at its output a first and second open loop objective current value $I_{OLSUP}$ and $I_{OLINF}$ (hereinafter simply indicated as "objective open loop current values"), which must be supplied to the upper electromagnets 6*a* and lower electromagnets 6*b* to retain the valve 2 in the fully open and closure positions respectively during the stationary phases.

During the motion phases the closed loop control block 13 acts in a first closed loop control mode, or motion control mode, for controlling the motion of the valve 2 as illustrated in detail hereinafter. For this purpose it receives at its input the measurements of the upper and lower current $I_{SUP}$ and $I_{INF}$ and the real position Z, the estimate of the real velocity V, the objective position signal $Z_T$ and a plurality of parameters indicative of the operating conditions of the engine such as, for example, the load L and the velocity of rotation RPM. The closed loop control block 13 generates at its output first and second closed loop objective current values $I_{CLSUP}$ and $I_{CLINF}$ (hereinafter simply indicated as "closed loop objective current values") which must be supplied to the upper and lower electromagnets 6*a* and 6*b* during the motion phases of the valve 2.

The first selector 14 is controlled by the first switching signal SW1 in such a way as selectively to connect the open loop control block 12 or the closed loop control block 13 to the piloting and measurement block 15. In particular, when the first switching signal SW1 assumes the first switching value ("OPEN"), the first selector 14 connects the output of the closed loop control block 12 to the input of the measurement and piloting block 15, which, therefore receives the open loop objective current values $I_{OLSUP}$ and $I_{OLINF}$. When, on the other hand, the first switching signals SW1 has the second switching value ("CLOSED"), the measurement and piloting block 15 receives, via the first selector 14, the closed loop objective current values $I_{CLSUP}$ and $I_{CLINF}$ from the closed loop control block 13, the measurement and piloting block 15 delivers an upper current $I_{SUP}$ and, respectively, a lower current $I_{INF}$ to the upper and lower electromagnets 6*a* and 6*b*, having values equal to the objective current values received at its input.

Moreover, the measurement and piloting block 15 receives at its input the upper exhaust signals $F_{DSUP}$ and the lower exhaust signal $F_{DINF}$ and determines the mode of operation of the electromagnets 6*a*, 6*b*. In detail, if the upper and lower exhaust signals $F_{DSUP}$ and $F_{DINF}$ are set to the first exhaust value ("SLOW") a slow exhaust mode is selected, which is obtained by supplying the upper and lower electromagnets 6*a* and 6*b* between a supply source providing a voltage equal to about 15 volts, for example, and ground. When the upper and lower exhaust signal $F_{DSUP}$ and $F_{DINF}$ assume the second exhaust value ("FAST") a rapid exhaust mode is selected by connecting the upper and lower electromagnets 6*a*, 6*b* respectively between supply sources of, for example, plus 15 v and minus 15 v.

Figure 3:
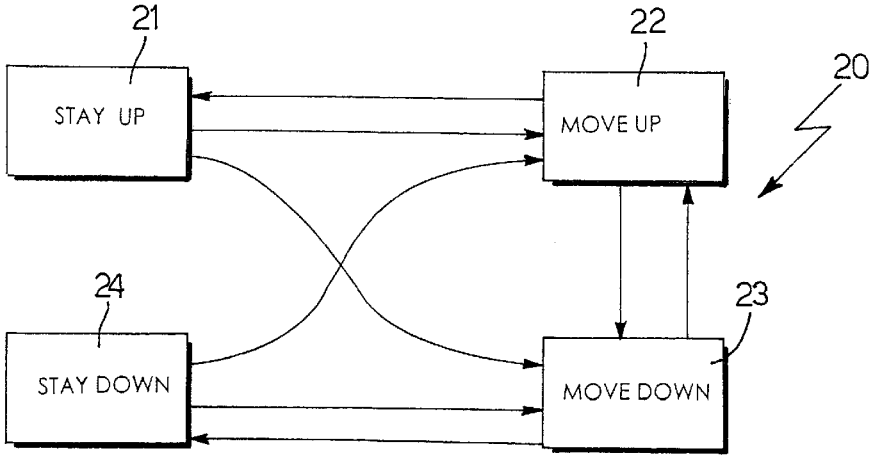
FIG. 3 is a detailed block diagram of the block diagram of FIG. 2.

FIG. 3 illustrates the operation of the supervision block 11 which implements a finite state machine 20 comprising four states from which the control state ("STATE") can be selected, defined by sets of values of the command signal COM, the real position Z and the real velocity V.

In detail, in a first state 21 ("STAY UP") the command signal is set to the first command value ("UP"), the real position Z is not less than an upper threshold position $Z_{UP}$ and the estimate of the real velocity is less, in absolute value, than an upper threshold value $V_{UP}$. In the first state 20, moreover, the first state signal ST1 has assigned to it a first state value ("S1"), the objective position $Z_T$ is set equal to the closure position $Z_{SUP}$, the first switching signal SW1 is at the first switching value ("OPEN"), whilst the upper and lower exhaust signal $F_{DSUP}$ and $F_{DINF}$ both assume the first exhaust value ("SLOW").

From the first state 20 it passes to a second state 22 ("MOVE UP"), if the real position Z, for example because of a disturbance, falls below the upper position threshold $Z_{UP}$ or if the real velocity V is in absolute value, greater than the upper velocity threshold $V_{UP}$; on the other hand it passes to a third state 23 ("MOVE DOWN") if the command signal COM assumes the second command value ("DOWN").

When the finite state machine 20 is in the second state 22 the command signal COM is at the first command value ("UP"), whilst the real position Z lies between the upper threshold position $Z_{UP}$ and a lower threshold position $Z_{DOWN}$. Moreover, the first state signal ST1 assumes a second state value ("S2"), the objective position is set equal to the closure position $Z_{SUP}$ the first switching signal SW1 is set equal to the second switching value ("CLOSED") and the upper and lower exhaust signal $F_{DSUP}$ and $F_{DINF}$ assume the second exhaust value ("FAST").

From the second state 22 the finite state machine 20 goes to the first state 21 if the real position Z rises above the upper threshold position $Z_{UP}$ and, simultaneously the real velocity V is less, in absolute value, than the upper threshold velocity $V_{UP}$; if the command signal COM assumes the second command value ("DOWN") it passes to the third state 23.

In the third state 23 the command signal COM is at the second command value ("DOWN") and the real position Z lies between the upper threshold position $Z_{UP}$ and a lower threshold position $Z_{DOWN}$. In the third state 23 the first state signal ST1 assumes a third state value ("S3"), the objective position $Z_T$ is equal to the fully open position $Z_{INF}$, the switching signal SW is set to the second switching value ("CLOSED"), whilst the upper and lower exhaust signal $F_{DSUP}$ and $F_{DINF}$ assume the second exhaust value ("FAST").

From the third state 23 it passes to a fourth state 24 ("STAY DOWN") if the real position Z falls below the lower threshold position $Z_{DOWN}$ and simultaneously the real velocity V falls in absolute value below a lower velocity threshold $V_{DOWN}$; if the command signal COM assumes the first command value ("UP") the state machine 20 goes to the second state 22.

The fourth state 24 is defined by the second command value ("DOWN") for the command signal COM and by values of real position Z and real velocity V less than the lower threshold position $Z_{DOWN}$ and respectively (in absolute value) the lower velocity threshold $V_{DOWN}$. In the fourth state 24 the first state signal ST1 assumes a fourth state value ("S4"), the objective position $Z_T$ is set equal to the fully open position $Z_{INF}$, the switching signal SW is at the first switching value ("OPEN") and the upper and lower exhaust signals $F_{DSUP}$ and $F_{DINF}$ are assigned the first exhaust value ("SLOW").

From the fourth state 24 the finite state machine 20 goes to the third state 23 if the real position Z goes above the lower threshold position $Z_{DOWN}$ or if the real velocity V exceeds in absolute value the lower velocity threshold $V_{DOWN}$; otherwise, it goes to the second state 22 if the command signal COM assumes the first command value ("UP").

For greater clarity, in FIG. 4 there is shown a table which illustrate the values assumed by the command signal COM, the first switching signal SW1 and the exhaust signals $F_{DSUP}$, $F_{DINF}$ for each possible value of the state signal ST.

Moreover, FIG. 5 shows the closure position $Z_{SUP}$, fully open position $Z_{INF}$ and the upper and lower position threshold $Z_{UP}$, $Z_{DOWN}$, with respect to an axis of the real position Z parallel to the longitudinal axis B of the valve 2 and orientated along the direction of closure of the valve 2 itself. In FIG. 5 there are also shown an opening threshold $Z_{OPEN}$ and a closure threshold $Z_{CLOSE}$, the significance of which will be explained hereinafter.

In the proposed method it is therefore possible to alternate the open loop control mode and the first closed loop or motion control mode. In particular, the open loop control mode is performed during the stationary phases of the valve 2 when the control state ("STATE") selected is the first state 21 or the fourth state 24 and the first switching signal SW1 has the first switching value ("OPEN"); the first closed loop control mode is performed, on the other hand, during the motion phases, in which the control state is the second state 22 or the third state 23 and the first switching signal SW1 is assigned the second switching value ("CLOSED").

As previously indicated, during the stationary phases in which the open loop control mode is selected and corresponding to the first state 21 or the fourth state 24 of the finite state machine 20, the first selector 14 connects the measurement and piloting block 15 to the open loop control block 12 which provides the open loop objective current values $I_{OLSUP}$ and $I_{OLINF}$. In particular, if the valve 2 is in the closure position $Z_{SUP}$ the finite state machine 20 is in the first state 21 and, consequently, the first state signal ST1 assumes the first state value ("S1"). In this case, the open loop control block 12 sets the open loop objective current values $I_{OLSUP}$ and $I_{OLINF}$ equal to an upper maintenance value $I_{HUP}$ and zero respectively. On the other hand, if the valve 2 is disposed in the fully open position $Z_{INF}$ and thus the finite state machine 20 is in the fourth state 24, the state signal is set to the fourth state value ("S4") and the open loop control block 12 sets the open loop objective current values $I_{OLSUP}$ and $I_{OLINF}$ equal to zero and, respectively, a lower maintenance value $I_{HDOWN}$.

The upper and lower maintenance values $I_{HUP}$ and $I_{HDOWN}$ represent the minimum current values to be supplied to the actuator 1 to maintain the valve 2 in the desired position.

During the motion phase, corresponding to the second and third state (22,23) of the finite state machine 20, the first closed loop control mode is selected. In particular, the first switching signal SW1 is at the second switching value ("CLOSED") and the first selector 14 connects the measurement and piloting block 15 to the closed loop control block 13 which operates for example as shown in Italian patent application no. BO99A 000594 Filed by the applicant on May 11, 1999.

Figure 6:
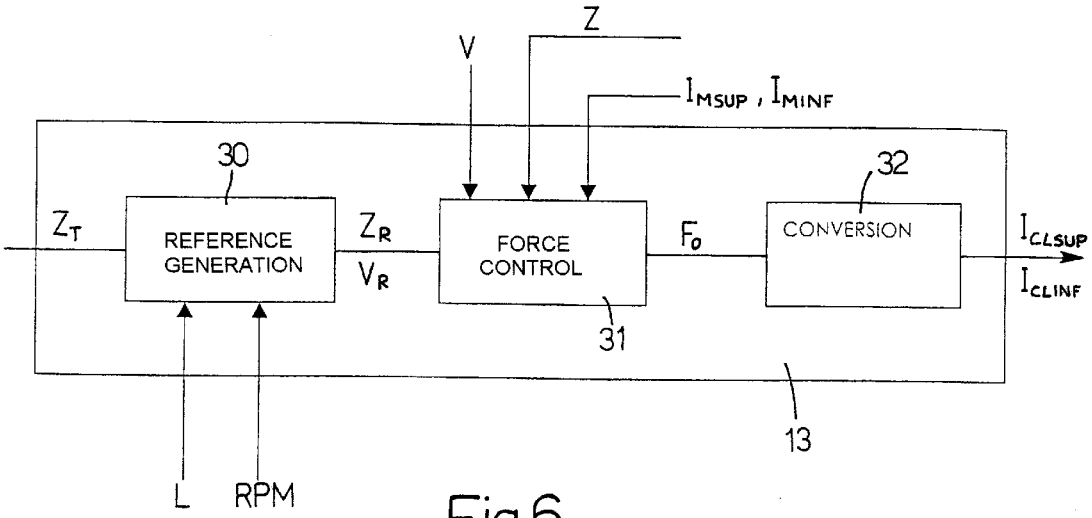
FIG. 6 is a detailed block diagram of a second detail of a block diagram of FIG. 2.

As illustrated in detail in FIG. 6, the open loop control block 13 comprises a reference generation block 13 which receives at its input the objective position signal $Z_T$ and the engine parameters (that is to say the load L and the velocity of rotation RPM) and provides at its output a position reference profile $Z_T$ and a velocity reference profile $V_R$ representing the position and the velocity which, instant by instant, it is desired to impose on the valve 2 during the motion phases; a fourth control block 31 receiving at its input the measurements of the upper current $I_{SUP}$, the lower current $I_{INF}$ and the real position Z, the estimate of the real velocity V, the position reference profiles $Z_R$ and velocity reference profiles $V_R$ and providing at its output an objective force value $F_O$ indicative of the resultant force F to be applied to the rocker arm 3 for the purpose of minimising disturbances to the real position Z and the real velocity V with respect to the position reference profile $Z_R$ and, respectively, the velocity reference profile $V_R$; and a conversion block 32 receiving at its input the objective force value $F_O$ and providing at its output the pair of closed loop objective current values $I_{CLSUP}$ and $I_{CLINF}$ which must be applied to the upper and the lower electromagnets 6 to generate the objective force value $F_O$.

During operation of the engine the reference generation block 31 determines the position reference profile $Z_R$ and the velocity reference profile $V_R$ on the basis of the values of the objective position signal $Z_T$, the load L and the velocity of rotation RPM. These profiles can be, for example, calculated starting from the objective position signal $Z_T$ by means of a non-linear two state filter implemented in a known manner generated by the reference generation block 30, or extracted from tables defined in a calibration phase.

The force control block 31 then utilises the position reference profile $Z_R$ and velocity reference profile $V_R$, together with values of the real position Z and the real velocity V to determine the objective force value $F_O$ of the resultant force F which must be applied to the rocker arm 3 according to the following equation:

$$F_o=(N_1Z_R+N_2V_R)-(K_1Z+K_2V) \quad (1)$$

In equation (1) $N_1$, $N_2$, $K_1$, and $K_2$ are gains which can be calculated by applying well known robust control techniques to a dynamic system which represents the motion of the valve 2 and is described by the matrix equation:

$$\begin{bmatrix} \dot{Z} \\ \dot{V} \end{bmatrix} = \begin{bmatrix} 0 & 1 \\ K/M & B/M \end{bmatrix} \begin{bmatrix} Z \\ V \end{bmatrix} + \begin{bmatrix} 0 \\ 1/M \end{bmatrix} F \quad (2)$$

in which $\dot{Z}$ and $\dot{V}$ are the time derivatives of the real position Z and the real velocity V respectively, K is an elastic constant, B is a viscosity constant and M is a total equivalent mass. In particular, the resultant force F and the real position Z represent an input and output respectively of the dynamic system.

The value of the objective force $F_O$ calculated by the force control block 31 according to equation (1) is utilised by the conversion block 32 to determine the closed loop objective current values $I_{CLSUP}$ and $I_{CLINF}$. These current values can be derived in a manner known per se by inversion of a mathematical model or on the basis of tables representative of distance-force-current characteristics.

Figure 7:
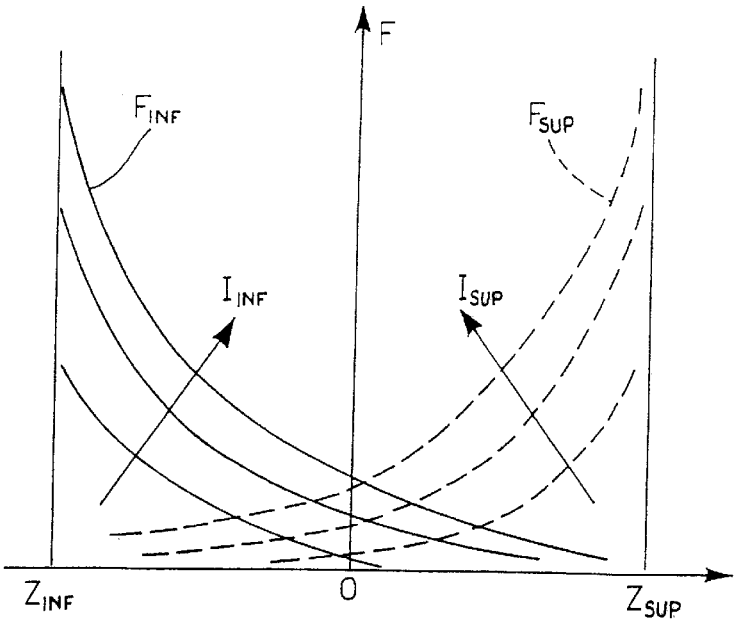
FIG. 7 is a graphical representation of the distance-force-current characteristics of the electromagnetic actuators.

An example of such characteristics is illustrated in the graph of FIG. 7 with reference to the electromagnet-valve unit as described.

In detail, along the abscissa is plotted the real position Z of the valve 2, indicative of the position of the rocker arm 3 with respect to the upper and lower electromagnets 6*a*, 6*b*; the origin is the rest point at which the rocker arm 3 is at equal distance from the pole pieces of the two electromagnets, whilst the points $Z_{UP}$ and $Z_{INF}$ represent the closed and fully open positions respectively. Upon variation of the current $I_{SUP}$ and $I_{INF}$ consumed by the upper and lower electromagnets 6*a*, 6*b* the forces generated by these on the rocker arm 3 are illustrated by the first family of curves represented by solid lines and indicated $F_{SUP}$ and, respectively a second family of curves represented by broken line indicated $F_{INF}$.

It is important to underline that, according to the above mentioned patent application, both the electromagnets 6 can be supplied repeatedly, simultaneously or in sequence during the motion phase of the valve 2, to allow the resultant force F exerted on the rocker arm 3 to have a value equal to the value of the objective force $F_O$.

A second embodiment of the present method will now be described hereinafter with reference to FIGS. from 7 to 10, in which those parts which are the same as those already illustrated in FIGS. from 2 to 5 are indicated with the same reference numerals.

Figure 8:
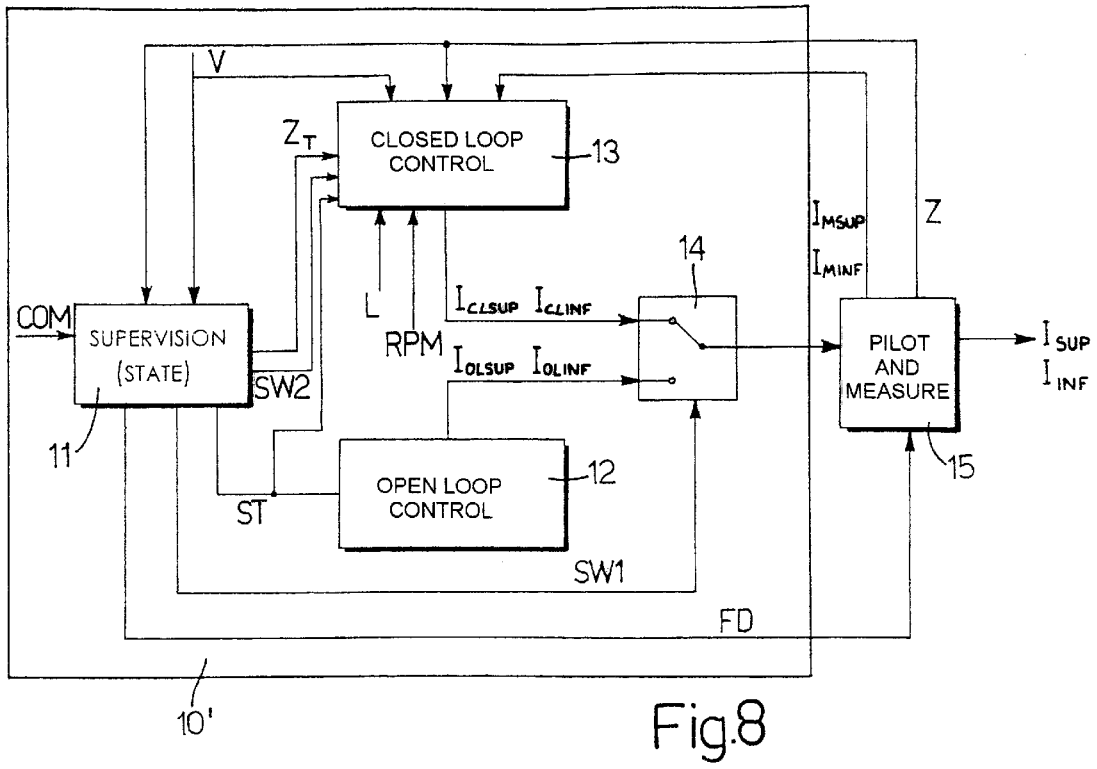
FIG. 8 is a simplified block diagram relating to the control method according the present invention in a second embodiment.

In detail, in FIG. 8 there is shown a control unit 10' similar to the control unit 10 of FIG. 2 and differing in the fact that the closed loop control block 13 receives at its input the state signal ST and a second switching signal SW2 generated by the supervision block 11.

Figure 9:
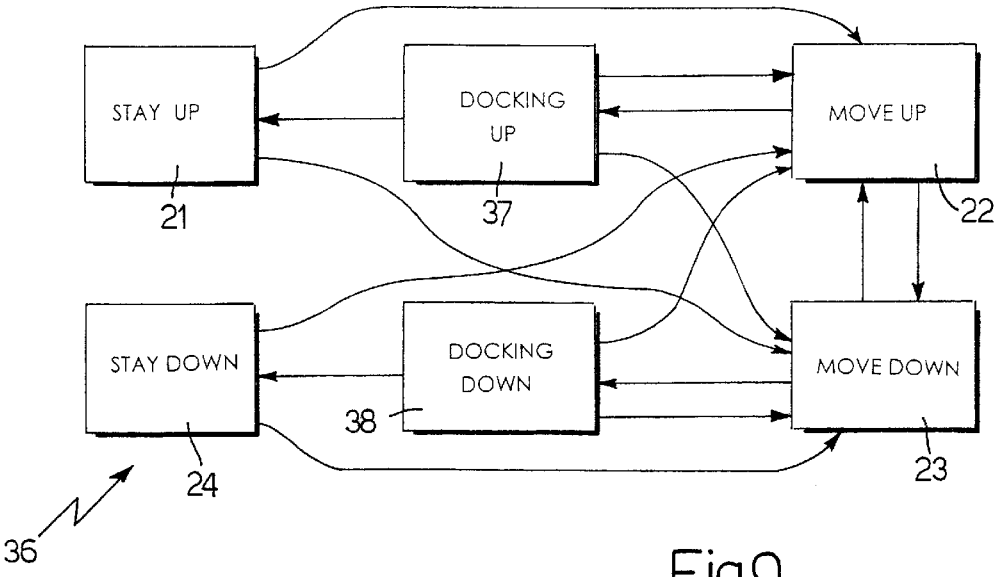
FIG. 9 is a detailed block diagram of a first detail of the block diagram of FIG. 8.

In the variant, moreover, the supervision block 11 implements the second finite state machine 36 (FIG. 9) comprising six states from among which can be selected the control state ("STATE") defined by sets of values of the command signal COM for the real position Z and the real velocity V. In particular, the finite state machine 36 comprises the first, second, third and fourth state 21,22.23 and 24 of the finite state machine 30 and, in addition a fifth state 37 ("DOCKING UP") and a sixth state 38 ("DOCKING DOWN").

Moreover, the state signal ST has a separate value for each of the states of the finite state machine 36.

In the first state 21 the command COM is set to the first command value ("UP") and the real position Z is equal to the closure position $Z_{SUP}$; moreover, the state signal ST has assigned to it the first state value ("S1"), the objective position $Z_T$ is set equal to the closure position $Z_{SUP}$, the first switching signal SW1 is at the first switching value ("OPEN"), whilst the upper and lower exhaust signal $F_{DSUP}$ and $F_{DINF}$ both assume the first exhaust value ("SLOW").

From the first state 20 it passes to the second state 22 if the valve 2 tends to open for example because of a disturbance, that is to say if the real position Z falls below the open threshold $Z_{OPEN}$ lying between the closure position $Z_{SUP}$ and the upper threshold position $Z_{UP}$ (FIG. 5) or if the real velocity V exceeds in absolute value the upper velocity threshold $V_{UP}$. Moreover, from the first state 20 it passes to the third state 23 if the command signal COM assumes the second command value ("DOWN").

When the finite state machine 20 is in the second state 22 the command signal COM is at the first command value ("UP") whilst the real position Z lies between the upper position threshold $Z_{UP}$ and the lower position threshold $Z_{DOWN}$. Moreover, the first state signal ST1 assumes the second state value ("ST"), the objective position $Z_{UP}$ is set equal to the closure position $Z_{SUP}$, the first switching signal SW1 is set equal to the second switching value ("CLOSED"), the second switching signal SW2 assumes a third switching value ("CL1") whilst the upper and lower exhaust signals $F_{DSUP}$ and $F_{DINF}$ are set to the second exhaust value ("FAST").

From the second state 22 the finite state machine moves then to the fifth state 37 if the real position Z rises above the upper position threshold $Z_{UP}$ and, simultaneously, the real velocity V is less in absolute value than the upper velocity threshold $V_{UP}$; if the command signal COM assumes the second command value ("DOWN") it passes to the third state 23.

In the third state 23 the command signal COM is at the second command value ("DOWN") and the real position Z lies between the upper position threshold $Z_{UP}$ and the lower position threshold $Z_{DOWN}$. In the third state 23 the first state signal ST1 assumes the third state value ("S3"), the objective position $Z_T$ is equal to the fully open position $Z_{INF}$, the first and seconds switching signals SW1,SW2 are set to the second and third switching value respectively ("CLOSED", "CL1"), whilst the upper and lower exhaust signals $F_{DSUP}$ and $F_{DINF}$ both assume the second exhaust value ("FAST").

From the third state 23 it passes to the sixth state 38 if the real position Z falls below the lower position threshold $Z_{DOWN}$ and, simultaneously, the velocity V falls in absolute value beneath the lower velocity threshold $V_{DOWN}$; if the command signal COM assumes the first command value ("UP"), the state machine 20 goes to the second state 22.

The fourth state 24 is defined by the second command value ("DOWN"), by the command signal COM and by the fully open value $Z_{INF}$ for the real position Z. in the fourth state 24 the first state signal ST1 assumes the fourth state value (S4), the objective position $Z_T$ is set equal to the fully open position $Z_{INF}$ and the first switching signal SW1 is assigned the first switching value ("OPEN"), whilst the upper and lower exhaust signals $F_{DSUP}$ and $F_{DINF}$ both assume the first exhaust value ("SLOW").

From the fourth state 24 the finite state machine 20 goes to the third state 23 if the valve 2 tends to close, that is to say if the real position Z rises above the opening threshold $Z_{DOWN}$, lying between the filly open position $Z_{INF}$ and the lower position threshold $Z_{DOWN}$ (FIG. 5 ), or if the real velocity V exceeds in absolute value the lower velocity threshold $V_{DOWN}$. Moreover, from the fourth state 24 it passes to the second state 22 if the command signal COM assumes the first command value ("UP").

In the fifth state 37 the command signal COM is at the first command value ("UP"), the real position Z is not less than the upper position threshold $Z_{UP}$ and the estimate of the real velocity V is less in absolute value than the upper velocity threshold $V_{UP}$. Moreover, the objective position $Z_T$ is equal to the closure position $Z_{SUP}$, the first and second switching signals SW1, SW2 are at the second switching value ("CLOSED") and, respectively, at a fourth switching value ("CL2"), whilst the upper and lower exhaust signals $F_{DSUP}$ and $F_{DINF}$ assume the second exhaust value ("FAST") and the first exhaust value ("SLOW") respectively.

From the fifth state 37 the following transitions can be made: towards the first state 21 if the condition that real position Z is not less than the upper position threshold $Z_{UP}$ and the estimate of the real velocity V is less in absolute value than the upper velocity threshold $V_{UP}$ remains at least for a predetermined time interval; towards the second state 22 if the real position Z goes to a value less than the upper position threshold $Z_{UP}$ or if the absolute value of the real velocity V exceeds the upper velocity threshold $V_{UP}$; and towards the third state 23 if the command signal COM assumes the second command value ("DOWN").

In the sixth state 38 the command signal COM is at the second command value ("DOWN"), the real position Z is not greater than the lower position threshold $Z_{DOWN}$ and the real velocity V is less than the lower position threshold $Z_{DOWN}$ and, respectively, (in absolute value) the lower velocity threshold $V_{DOWN}$. Moreover, the objective position $Z_T$ is equal to the fully open position $Z_{INF}$, the first and second switching signals SW1, SW2 are at the second and the fourth switching value ("CLOSED", "CL2") respectively; moreover, the upper and lower exhaust signals $F_{DSUP}$ and $F_{DINF}$ assume the first exhaust value ("SLOW") and the second exhaust value ("FAST") respectively.

From the sixth state 38 the following transitions can be made: towards the fourth state 24 if the condition that the real position Z is not greater than the lower position threshold $Z_{DOWN}$ and the real velocity V is lower in absolute value than the lower velocity threshold $V_{DOWN}$ remains at least for a predetermined time interval; towards the third state 23 if the real position Z goes to a value greater than the lower position threshold $Z_{DOWN}$ or if the absolute value of the real velocity V exceeds the upper velocity threshold $V_{DOWN}$; and towards the second state 22 if the command signal COM assumes the first command value ("UP").

In FIG. 10 there is shown a table which illustrates the values assumed by the command signal COM, the first and second switching signal SW1,SW2, and the upper and lower exhaust signals $F_{DSUP}$ and $F_{DINF}$ in correspondence with each possible value of the state signal ST.

Figure 11:
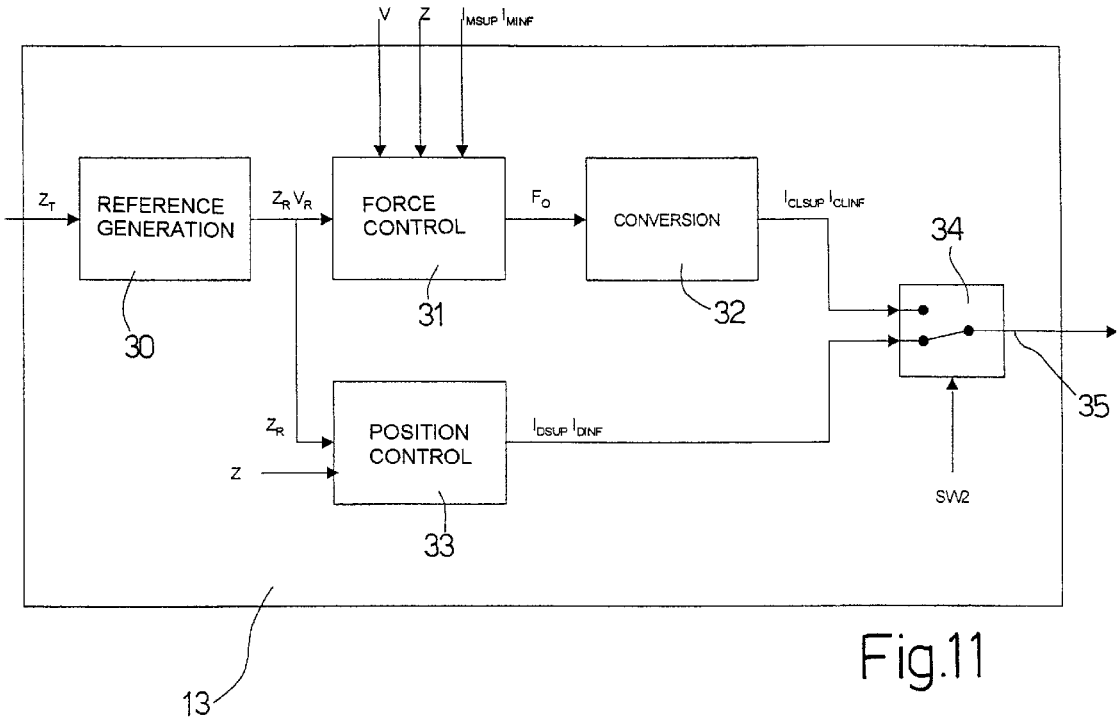
FIG. 11 is a detailed block diagram of a second detail of the block diagram of FIG. 8.

With reference to FIG. 11, the closed loop control block 13 comprises, according to the variant, the reference generation block 30, the force control block 31, the conversion block 32 connected together as illustrated in FIG. 6, and, further, a position control block 33 and a second selector 34.

The position control block 33 receives at its input the real position Z, the reference position Zr and a second state signal ST2, and at its output provides a first and a second docking current $I_{DSUP}$ and $I_{DINF}$ (hereinafter simply indicated as "docking current values $I_{DSUP}$ and $I_{DINF}$".

The second selector 34 is controlled by the second switching signal SW2 in such a way as to connect its output 35, defining the output of the closed loop control block 13, selectively with the output of the conversion block 32 and with the output of the position control block 33.

In the variant, the state signal ST determines the mode on the basis of which the position control block 33 makes the calculation of the current docking values. In particular, if the state signal is to assume the fifth state value S5 the docking current values $I_{DSUP}$ and $I_{DINF}$ are provided on the basis of the equations;

$$I_{DSUP}=I_{NOM}+I_G|Z_{SUP}-Z| \tag{3}$$

$$I_{DINF}=0 \tag{4}$$

Where $I_{NOM}$ is a nominal current value and $I_G$ is a current gain, both predetermined. If, on the other hand, the state signal ST assumes the sixth state value S6 the position control block 33 calculates the docking current values $I_{DSUP}$ and $I_{DINF}$ on the basis of the equations:

$$I_{DINF}=0 \tag{5}$$

$$I_{DINF}=I_{NOM}+I_G|Z_{SUP}-Z| \tag{6}$$

In all other cases both the docking current values $I_{DSUP}$ and $I_{DINF}$ are set equal to 0. In particular, the nominal current value $I_{NOM}$ and the current gain $I_G$ can be chosen during the design stage in a manner known per se such that the docking current values $I_{DSUP}$ and $I_{DINF}$, calculated as a function only of the real position Z using linear relations, are on average less than the closed loop objective current values $I_{CLSUP}$ and $I_{CLINF}$ and have more gradual variation times than these.

Moreover, the second selector 34 connects the output 35 to the output of the conversion block 32 when the second switching signal is at the third switching value ("CL1") and the output of the position control block 33 when the second switching signal is at the fourth switching value ("CL2").

In this way a first and second closed loop mode are defined in practice which are selected alternatively on the basis of the value of the second switching signal SW2.

In particular, the first control mode, or motion control mode, coincides with that described with reference to FIGS. from 2 to 5 and is selected when, during the motion phases, the second switching signal is at the third switching value ("CL1"). In this case the closed loop control block 13 provides at its output the closed loop objective current values $I_{CLSUP}$ and $I_{CLINF}$ according to the method previously described. On the other hand, the second closed loop control mode or docking control mode, is selected during docking phases in which the second switching signal SW2 assumes the fourth switching value. These docking phases are defined when the real position Z is greater than the upper position threshold $Z_{UP}$ or less than the lower threshold $Z_{DOWN}$ and therefore the valve 2 is close to the closure position or fully open position. Therefore, when the docking control mode is operated the closed loop control block 30 provides at its output the docking current values $I_{DSUP}$ and $I_{DINF}$.

The advantages offered by the present invention are clear from the above explanations. In particular, the method proposed makes it possible to optimise the efficiency of the engine, reducing electrical power consumption during the stationary phases and effecting a precise control of the movements of the valves during the motion phases. In fact, the upper and lower maintenance values $I_{HUP}$ and $I_{HDOWN}$ provided in the stationary phases in which the open loop control mode is selected, are very much lower, it being enough to maintain the valves in the desired positions only in the absence of disturbances. However, when disturbing forces intervene causing unwanted opening or closure, a closed loop control mode is selected in such a way as rapidly to bring the valves into the respective objective positions preventing the flow of air to the cylinders from becoming significantly altered. During the motion phases, on the other hand, the closed loop control mode makes it possible to give the valves optimal movement profiles in dependence on the operative conditions of the engine. Moreover, it is possible to damp the velocity of the valves close to the ends of their strokes thus avoiding impacts against fixed parts which would drastically reduce the useful life of the valve itself.

A further advantage is achieved by means of the second embodiment described, which makes it possible to select different closed loop control modes during the motion phases and during the docking phases. In fact, the docking control allows the motion of the valves to be controlled with a lower expenditure of energy given that smaller currents are delivered. On the other hand, during the motion phases the motion control mode makes it possible to obtain greater precision and velocity.

They are further advantages in the use of different operating modes for the actuators during the motion and stationary phases. During the motion phases, in particular, the rapid exhaust mode makes it possible quickly to pilot the electromagnets and therefore to make the control more robust. During the stationary phase, the slow exhaust mode makes it possible further to reduce the consumption of electrical power.

Figure 12:
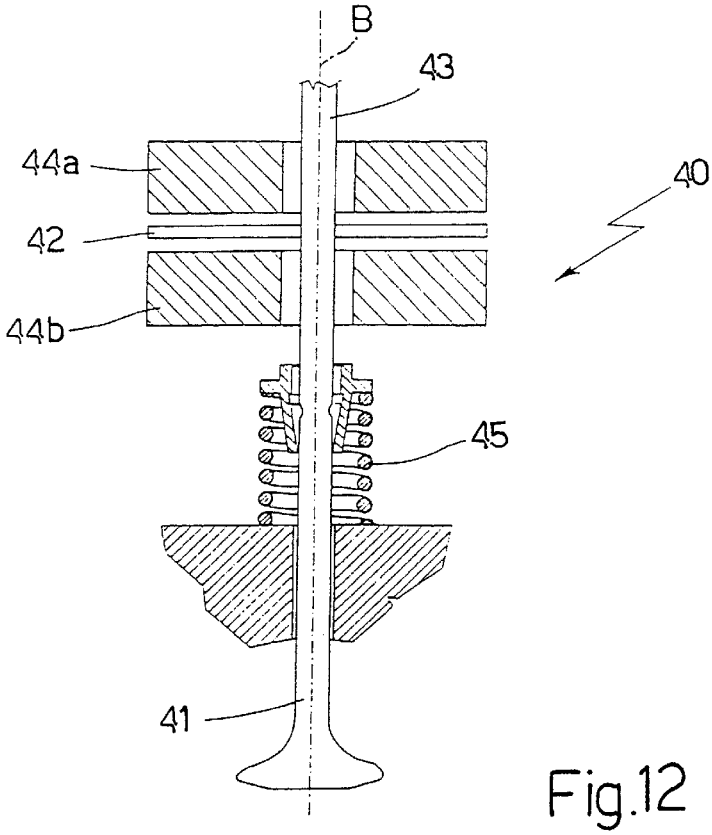
FIG. 12 is a partially sectioned side view of a second type of induction or exhaust valve and the corresponding electromagnetic actuator.

Moreover, the method proposed can be utilised even for the control of different sets of valve actuators from those described with reference to FIG. 1. For example, as shown in FIG. 12, an actuator 40 co-operates with an induction or exhaust valve 41 and comprises: a core 42 of ferromagnetic material securely fixed to a rod 43 of the valve 41 and disposed perpendicularly to its longitudinal axis B; an upper electromagnet 44*a* and a lower electromagnet 44*b* both at least partially surrounding the stem 43 of the valve 41 and disposed on opposite sides with respect to the core 42 in such a way as to be able to act when commanded, alternatively or simultaneously, by exerting a resultant force F on the core 42 to make it translate parallel to the longitudinal axis B; and a resilient element 45 operable to maintain the core 42 in a rest position in which it is equidistant from the pole pieces of the lower and upper electromagnets 44*a* and 44*b* in such a way as to maintain the valve in an intermediate position between the closure position $Z_{SUP}$ and the fully open position $Z_{INF}$.

Finally, it is evident that the method described can have modifications and variations introduced thereto without departing from the ambit of the present invention.

What is claimed is:

1. A method for controlling electromagnetic actuators for the induction and discharge valves of internal combustion engines in which an actuator (1,40), connected to a control unit (10) is coupled to a respective valve (2,41) having a real position (Z) and including a movable element (3,42) operated magnetically by means of a resultant force (F) to control the movement of the said valve (2,41) between a closure position ($Z_{SUP}$) and a fully open position ($Z_{INF}$); the said control unit being connected to piloting means (15) and including supervision means (11), open loop control means (12), closed loop control means (13) and first selector means (14) controlled by a first switching signal (SW1) generated by the said supervision means (11); the said selector means being operable to connect the said piloting means (15) selectively to the said open loop control means (12) and to the said closed loop control means (13); the method being characterised in that it comprises the steps of:

a) operating in an open loop control mode (12) for controlling the real position (Z);

b) operating in at least one closed loop control mode (13) for controlling the real position (Z); and c) alternatively selecting the said open loop control mode (12) and the said closed loop control mode (13).

2. A method according to claim 1, characterised in that the said alternative selection step c) comprises the steps of:

c1) selecting the said open loop control mode (12) during stationary phases of the said valve (2,41); and c2) selecting the said closed loop control mode (13) during motion phases of the said valve (2,41).

3. A method according to claim 1, characterised in that the said alternative selection step c) further comprises the steps of:

c3) updating a control state ("STATE").

4. A method according to claim 3, characterised in that the said step c3) of updating the said control state ("STATE") comprises the steps of:

c31) selecting the said control state ("STATE") from a first, second, third and fourth state (21,22,23,24).

5. A method according to claim 4, characterised in that the said step c3) of updating the said control state ("STATE") further comprises the step s of:

c32) selecting the said control state ("STATE") from the said first and fourth state (21,24) during the said stationary phases; and c33) selecting the said control state ("STATE") from the said second and third state (22,23) during the said motion phases.

6. A method according to claim 1, characterised in that the said step a) of operating in the said open loop control mode (12) comprises the step of:

a1) connecting the said open loop control means (12) to the said piloting means (15).

7. A method according to claim 6 in which the said actuator (1) comprises first and second electromagnets (6*a*, 6*b*,44*a*,44*b*) disposed on opposite sides of the said movable element (3,42) and receiving first and second currents ($I_{SUP}$, $I_{INF}$) respectively; characterised in that the said step a) of operating in the said open loop control mode (12) further comprises the steps of:

a2) providing first and second open loop objective current values (12) ($I_{OLSUP}$, $I_{LINF}$);

a3) delivering the said first and second current ($I_{SUP}$ $I_{INF}$) of value equal to the said first, and respectively, second open loop objective current value (12) ($I_{OLSUP}$ $I_{LOINF}$).

8. A method according the claim 7, characterised in that the said phase a2) of providing the said first and second open loop objective current value (12) ($I_{OLSUP}$,$I_{LOINF}$) comprises the steps of:

a21) setting the said first open loop objective current value (12) ($I_{OLSUP}$) equal to a first maintenance value ($I_{HUP}$) and the said second open loop objective current value (12) ($I_{LOINF}$) substantially equal to zero when the said control state ("STATE") is the said first state 21; and a22) setting the said first open loop objective current value (12) ($I_{OLSUP}$) substantially equal to zero and the said second open loop objective current value (12) ($I_{LOINF}$) equal to a second maintenance current value ($I_{HDOWN}$) when the said control state ("STATE") is the said fourth state (21).

9. A method according to claim 3, characterised in that that the said step b) of operating in the said closed loop control mode (13) includes the step of:

b1) connecting the said closed loop control means (13) to the said piloting means (15).

10. A method according to claim 9 where the said actuator (1) comprises first and second electromagnets (6*a*, 6*b*, 44*a*, 44*b*) disposed on opposite sides of the said moveable element (3,42) and receiving first and second currents ($I_{SUP}$, $I_{INF}$) respectively; characterised in that the said step b) of operating in the closed loop control mode (13) further comprises the step of:

b2) providing a first and a second closed loop objective current value (13) ($I_{CLSUP}$, $I_{CLINF}$); and b3) delivering the said first and second current ($I_{SUP}$,$I_{INF}$) of value equal to said first and second closed loop objective current value (13) ($I_{CLSUP}$, $I_{CLINF}$) respectively.

11. A method according to claim 10, characterised in that the said phase b2) of providing first and second closed loop objective current values (13) ($I_{CLSUP}$,$I_{CLINF}$) comprises the steps of:

b21) calculating an objective force value ($F_O$) of the said resultant force (F); and b22) calculating the said first and second closed loop objective current value (13) ($I_{CLSUP}$,$I_{CLINF}$) in dependence on the said objective force value ($F_O$).

12. A method according to claim 9, characterised in that the said step b) of operating in a closed loop control mode (13) comprises the steps of:

b4) operating in a motion control mode;

b5) operating in a docking control mode;

b6) alternatively selecting the said motion control mode and the said docking control mode.

13. A method according to claim 12, characterised in that the said step b6) of alternatively selecting the said motion control mode and the said docking control mode comprises the steps of:

b61) selecting the said motion control mode during motion phases of the said valve (2,41); and b62) selecting the said docking control mode during docking phases of the said valve (2,41).

14. A method according to claim 13, characterised in that the said step b6) of alternatively selecting the said motion control mode and the said docking control mode farther comprise the steps of:

b63) updating the said control state ("STATE") by selecting it from the said first, second, third, fourth state (21,22,23,24) and a fifth and sixth state (37,38).

15. A method according to claim 14, characterised in that the said step b63) of updating the said control state ("STATE") further comprises the steps of:

b631) selecting the said control state ("STATE") from among the said fifth and sixth states (37,38) during the said docking phases.

16. A method according to claim 15 where the said actuator (1) comprises first and second electromagnets (6*a*, 6*b*, 44*a*, 44*b*) disposed on opposite sides of the said movable element (3,42) and receiving first and second currents ($I_{SUP}$, $I_{INF}$) respectively; characterised in that the said phase b4) of operating in a motion control mode (13) further comprises the steps of:

b41) providing a first and second closed loop objective current value (13) ($I_{CLSUP}$,$I_{CLINF}$); and b42) delivering the said first and second current ($I_{SUP}$, $I_{INF}$) of value equal to the said first and second closed loop objective current value (13) ($I_{CLSUP}$,$I_{CLINF}$) respectively.

17. A method according to claim 16, characterised in that the said step b41) of providing first and second closed loop objective current values (13) ($I_{CLSUP}$,$I_{CLINF}$) comprises the steps of:

b411) calculating an objective force value (FO) of the said resultant force (F); and b412) calculating the said first and second closed loop objective current value (13) ($I_{CLSUP}$,$I_{CLINF}$) in dependence on the said objective force value ($F_O$).

18. A method according to claim 15 in what the said actuator (1) includes first and second electromagnets (6*a*, 6*b*,44*a*,44*b*) disposed on opposite sides of the said removable element (3,42) and receiving first and second currents ($I_{SUP}$,$I_{INF}$) respectively; characterised in that the said phase b5) of operating in a docking control mode comprises;

b51) providing the first and second docking current value ($I_{DSUP}$,$I_{DINF}$);

b52) delivers the said first and second current ($I_{SUP}$,$I_{INF}$) of a value equal to the said first and second docking current value ($I_{DSUP}$,$I_{DINF}$) respectively.

19. A method according to claim 18 characterised in that the said step b51) of providing the said first and second docking current value ($I_{DSUP}$,$I_{DINF}$) comprises the steps of;

b511) calculating the said first and second docking current value ($I_{DSUP}$,$I_{DINF}$) in dependence on the said real position (Z) according to linear relations.

* * * * *

UNITED STATES PATENT AND TRADEMARK OFFICE

CERTIFICATE OF CORRECTION

PATENT NO. : 6,671,156 B2
DATED : December 20, 2003
INVENTOR(S) : Di Lieto et al.

It is certified that error appears in the above-identified patent and that said Letters Patent is hereby corrected as shown below:

Title page,
Item [73], Assignee, amend the name of the Assignee as follows:

-- Magneti Marelli Powertrain S.p.A., Milan --

Signed and Sealed this

Twenty-second Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,671,156 B2
DATED : December 30, 2003
INVENTOR(S) : Di Lieto et al.

It is certified that error appears in the above-identified patent and that said Letters Patent is hereby corrected as shown below:

Title page,
Item [73], Assignee, amend the name of the Assignee as follows:

-- Magneti Marelli Powertrain S.p.A., Milan --

This certificate supersedes Certificate of Correction issued June 22, 2004.

Signed and Sealed this

Twenty-first Day of December, 2004

JON W. DUDAS
*Director of the United States Patent and Trademark Office*